US009957923B2

(12) United States Patent
Bourgoin et al.

(10) Patent No.: US 9,957,923 B2
(45) Date of Patent: May 1, 2018

(54) DEVICE FOR RECIRCULATING EXHAUST GAS FROM THE ENGINE OF AN AUTOMOBILE, AND USE OF SUCH A DEVICE

(71) Applicant: Valeo Systémes Thermiques, Le Mesnil-Saint-Denis (FR)

(72) Inventors: Guillaume Bourgoin, Limoges (FR); Bertrand Gessier, Montfort l'Amaury (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 0 days. days.

(21) Appl. No.: 14/805,182

(22) Filed: Jul. 21, 2015

(65) Prior Publication Data

US 2016/0010595 A1 Jan. 14, 2016

Related U.S. Application Data

(62) Division of application No. 13/807,428, filed as application No. PCT/EP2011/060132 on Jun. 17, 2011, now abandoned.

(30) Foreign Application Priority Data

Jun. 30, 2010 (FR) ..... 10 02778

(51) Int. Cl.
*F02M 25/06* (2016.01)
*F02M 25/07* (2006.01)
(Continued)

(52) U.S. Cl.
CPC ..... *F02M 25/074* (2013.01); *F02M 26/23* (2016.02); *F02M 26/29* (2016.02);
(Continued)

(58) Field of Classification Search
CPC ..... F02M 25/074; F02M 26/35; F02M 26/23; F02M 26/29; F02M 26/05; F02M 26/06
(Continued)

(56) References Cited

U.S. PATENT DOCUMENTS 4,740,404 A 4/1988 Otsugu et al.
6,820,599 B2 * 11/2004 Kurtz ..... F02B 1/12 123/568.21

(Continued)

FOREIGN PATENT DOCUMENTS

DE 10 2007 015146 10/2008
EP 0 219 296 A1 4/1987

(Continued)

OTHER PUBLICATIONS

International Search Report for Application No. PCT/EP2011/060132 dated Jun. 29, 2011; 7 pages.

(Continued)

*Primary Examiner* — Jason Shanske
(74) *Attorney, Agent, or Firm* — Howard & Howard Attorneys PLLC

(57) ABSTRACT

The invention concerns a device for recirculation of exhaust gases from an engine (1) of a motor vehicle, comprising a first exhaust gas recirculation line (9) called an EGR line, a first heat exchanger (10) provided on said EGR line (9) to ensure cooling of the recirculated exhaust gases, and treatment means (11) for the exhaust gases allowing limitation of the pH of the condensate arising from said gases. The treatment means (11) are provided upstream of the first exchanger (10) along the path of the exhaust gases, and the exchanger (10) comprises a heat exchanger bundle made of aluminum and/or aluminum alloy.

18 Claims, 1 Drawing Sheet

(51) Int. Cl.

| | |
|---|---|
| ***F02M 26/23*** | (2016.01) |
| ***F02M 26/29*** | (2016.01) |
| ***F02M 26/35*** | (2016.01) |
| *F02M 26/05* | (2016.01) |
| *F02M 26/06* | (2016.01) |

(52) U.S. Cl.
CPC ..... *F02M 26/35* (2016.02); *F02M 26/05* (2016.02); *F02M 26/06* (2016.02)

(58) Field of Classification Search
USPC ..... 60/278
See application file for complete search history.

(56) References Cited

U.S. PATENT DOCUMENTS

| | | | | |
|---|---|---|---|---|
| 7,013,879 | B2 | 3/2006 | Brookshire et al. | |
| 2004/0244782 | A1 | 12/2004 | Lewallen | |
| 2006/0153761 | A1* | 7/2006 | Bandl-Konrad | B01D 53/9431 423/239.1 |
| 2006/0266019 | A1 | 11/2006 | Ricart-Ugaz | |
| 2007/0261400 | A1 | 11/2007 | Digele et al. | |
| 2008/0149080 | A1 | 6/2008 | Reuss et al. | |
| 2008/0178843 | A1* | 7/2008 | Duffy | F02B 29/0412 123/435 |
| 2009/0077968 | A1 | 3/2009 | Sun | |
| 2009/0090486 | A1* | 4/2009 | Geskes | F28D 7/06 165/51 |
| 2009/0178396 | A1 | 7/2009 | Yezerets et al. | |
| 2009/0193794 | A1 | 8/2009 | Robel et al. | |
| 2013/0340427 | A1* | 12/2013 | Gonzalez Delgado | F02D 9/04 60/605.2 |

FOREIGN PATENT DOCUMENTS

| | | | |
|---|---|---|---|
| EP | 1 072 765 | A2 | 1/2001 |
| EP | 1 548 269 | A1 | 6/2005 |
| WO | WO 2006 040053 | A1 | 4/2006 |
| WO | WO 2008 091310 | A1 | 7/2008 |

OTHER PUBLICATIONS

English language abstract and machine-assisted English language translation of DE 10 2007 015 146 A1 extracted from www.espacenet.com on Jul. 21, 2015; 21 pages.

English language abstract not found; however, see English language equivalent U.S. Pat. No. 4,740,404 A for EP 0 219 296 A1. Original document extracted from www.espacenet.com on Jul. 21, 2015; 17 pages.

English language abstract and machine-assisted English language translation of EP 1 072 765 A2 extracted from www.espacenet.com on Jul. 21, 2015; 27 pages.

English language abstract and machine-assisted English language translation of WO 2006 040053 A1 extracted from www.espacenet.com on Jul. 21, 2015; 72 pages.

English language abstract for WO 2008 091310 A1 found; see English language equivalent U.S. 2008/178843 A1. Original document extracted from www.espacenet.com on Jul. 21, 2015; 34 pages.

* cited by examiner

DEVICE FOR RECIRCULATING EXHAUST GAS FROM THE ENGINE OF AN AUTOMOBILE, AND USE OF SUCH A DEVICE

RELATED APPLICATIONS

This application is a divisional of U.S. patent application Ser. No. 13/807,428, filed Dec. 28, 2012, which is the National Stage of International Patent Application No. PCT/EP2011/060132, filed Jun. 17, 2011, which claims priority to and all the advantages of French Patent Application No. FR 10/02778, filed on Jun. 30, 2010, the entire contents of which are hereby incorporated by reference.

FIELD OF THE INVENTION

The present invention concerns a device for recirculation of exhaust gases from an engine of a motor vehicle. It is used in particular in diesel engines.

DESCRIPTION OF THE RELATED ART

At present, to reduce polluting emissions, it is known to extract part of the exhaust gas from the engine and reinject this into the engine air intake circuit. This is usually called EGR (exhaust gas recirculation). To ensure correct filling of the cylinders and to protect the elements of the intake line, the recirculated gas is cooled using exchangers, known as EGR exchangers.

Because of the high proportion of water contained in the recirculated gas, condensation phenomena occur in the EGR exchangers. This condensation is by nature often acidic and aggressive, in particular because of the dissolution of hydrocarbons unburned by the engine and evacuated into the exhaust line. The result is an acid attack on components of the exchanger in contact with the condensate.

It is also noted that this acidity is higher in exhaust gas recirculation lines where, along these lines, the recirculated gases are not yet mixed with other gases, as they will be in the remainder of their journey towards the engine where they will be mixed with exterior air, generating more alkaline condensate.

To limit the risk relating to the acidity of condensate liable to occur in EGR exchangers, it is generally considered necessary to use EGR exchangers of stainless steel. They can also be made of cast aluminum with high material thickness. These solutions limit the performance, in particular the thermal performance, of the exchangers and increase their costs.

SUMMARY OF THE INVENTION

The invention proposes to remedy said drawbacks and its object is a device for recirculation of exhaust gases from an engine of a motor vehicle, comprising a first exhaust gas recirculation line called an EGR line, a first heat exchanger provided on said EGR line to ensure cooling of the recirculated exhaust gases, and treatment means for the exhaust gases allowing limitation of the pH of the condensate arising from said gases.

According to the invention, such treatment means are provided upstream of said first exchanger along the path of the exhaust gases and said exchanger comprises a heat exchanger bundle made of aluminum and/or aluminum alloy.

By providing such a treatment device, it is noted that the acidity of the condensate liable to occur in the EGR exchangers is reduced before the exhaust gases pass through said exchangers. It is thus possible to provide EGR exchangers in which the components no longer require such high performance against corrosion as before. They can therefore be optimized in terms of thermal performance and have a lower cost.

According to various embodiments of the invention:

- said bundle comprises components of aluminum and/or aluminum alloy obtained by rolling,
- said treatment means for the exhaust gases comprise an oxidation catalyst for the exhaust gases,
- said engine comprises an engine exhaust line, and said exhaust line comprises a turbine able to be driven by said exhaust gases, said first EGR line is able to communicate with said exhaust line upstream of said turbine, said treatment means being located along said first EGR line,
- said engine comprises an exhaust line, and said exhaust line comprises a turbine able to be driven by said exhaust gases, said first EGR line is provided so as to be able to communicate with said exhaust line downstream of said turbine, said treatment means being provided so as to be able to be located along said exhaust line, in particular downstream of said turbine,
- said device also comprises a second exhaust gas recirculation line, said second EGR line being able to communicate with said exhaust line upstream of said turbine,
- said device comprises a second heat exchanger provided on said second EGR line to cool the recirculated exhaust gases passing into said second line,
- said second exchanger comprises a heat exchanger bundle made of stainless steel,
- said treatment means are also provided along said second EGR line upstream of said exchanger, and said second exchanger comprises a heat exchanger bundle made of aluminum and/or aluminum alloy.

The invention also concerns the use of the device as described above with fuels of vegetable origin, standard European diesel and/or fuels from gas and/or coal. It has in fact been found that with these fuels, the reduction in the acidity of condensate obtained using the device according to the invention is all the more effective.

BRIEF DESCRIPTION OF THE DRAWINGS

The invention will be better understood in the light of the description below which is given merely for information, without being intended as restrictive, accompanied by the attached drawings in which.

DETAILED DESCRIPTION

Figure 1:
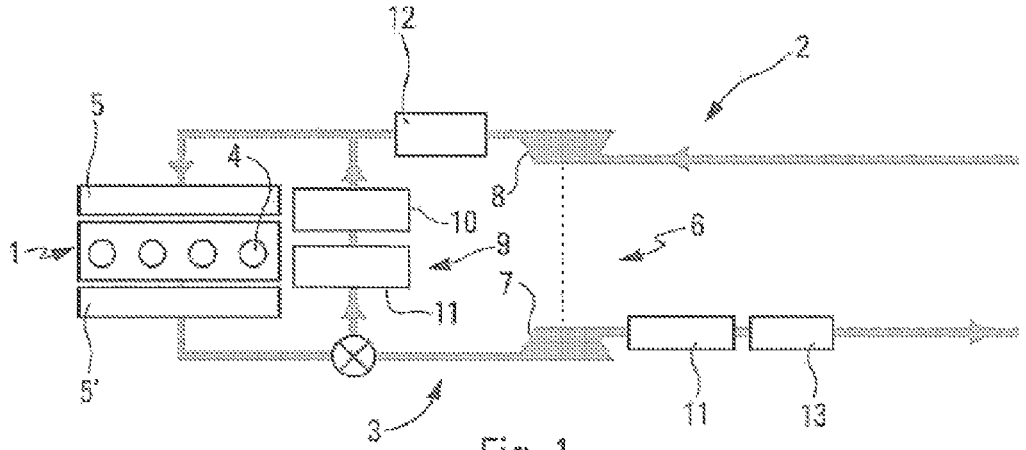
FIG. 1 illustrates diagrammatically a first exemplary embodiment of the device according to the invention.

As shown in the various figures, the invention is applied for example to an engine 1 of a vehicle with an air intake line 2 and/or an exhaust line 3. The intake line 2 allows the engine to be supplied with intake air, in particular fresh air. The exhaust line 3 allows evacuation of the exhaust gases generated by the combustion which took place in the combustion chambers 4 of the engine, by reaction of the intake air with the fuel introduced into the chambers.

The engine comprises for example an intake manifold 5 distributing the intake air from the intake line 2 into the combustion chambers 4, and an exhaust manifold 5' collecting the exhaust gases from the combustion chambers 4 to direct them towards the exhaust line 3.

A turbocompressor 6 can also be provided which allows compression of the intake air by the kinetic energy of the exhaust gases passing through the exhaust line 3. Said turbocompressor comprises for example a turbine 7 able to be driven by said exhaust gases and/or a compressor 8 driven by said turbine 7 and intended to compress the intake air passing through the intake line 2. The turbine 7 is thus provided at the level of the exhaust line 3 and the compressor 8 is provided at the level of the intake line 2, the turbine 7 and the compressor 8 being mechanically linked together so that the compressor 8 is driven by the turbine 7.

The intake line 2 can comprise a supercharging air cooler 12 allowing cooling of the charge air which passes through it before being introduced into the engine 1. Said charge air cooler 12 is provided downstream of the compressor 8.

The exhaust line 3 can comprise a particle filter 13 allowing a reduction in the polluting emissions from the exhaust gases. Said particle filter 13 is provided downstream of the turbine 7.

The device according to the invention comprises a first exhaust gas recirculation line 9 called an EGR line, and a first heat exchanger 10 provided on said EGR line to ensure cooling of the recirculated exhaust gases. Said EGR line opens at the level of the intake line 2. The flow of recirculated exhaust gases and/or intake air is ensured via various valves.

Said heat exchanger 10 is for example an exchanger, known as water exchanger, allowing the exchange of heat between a cooling liquid, in particular water with glycol from the vehicle cooling circuit, and the exhaust gases. For this, the exchanger comprises a heat exchanger bundle, not shown in detail, defining a first circuit for the cooling liquid and a second circuit for the recirculated exhaust gases, said first and second circuits having a thermal exchange connection. The term heat exchanger bundle signifies in particular all components of the bundle in contact with the exhaust gases passing through the exchanger.

The device according to the invention furthermore comprises treatment means 11 for the exhaust gases allowing limitation of the pH of the condensate arising from said gas.

According to the invention, said treatment means 11 are provided upstream of said first exchanger 10 along the path of the exhaust gases, and the heat exchanger bundle of said exchanger is made of aluminum and/or aluminum alloy. In fact by providing such treatment means downstream, it is no longer necessary to use components of stainless steel for the exchanger. Therefore aluminum can be used which helps achieve an improved thermal performance and a reduction in cost.

Thus components of aluminum and/or aluminum alloy could be used which are obtained by rolling. The exchanger bundle could therefore comprise plates made of such material, said plates being stacked to define exhaust gas circulation panels alternating with cooling liquid circulation panels.

The treatment means 11 for the exhaust gases comprise for example an exhaust gas oxidation catalyst, also called a two-way catalyst. Such a catalyst allows oxidation of the unburned hydrocarbons into carbon dioxide and water.

According to a first embodiment shown in FIG. 1, said first EGR line 9 is provided so as to be able to communicate with said exhaust line 3 upstream of said compressor 7. Said treatment means 11 are then located for example along said first EGR line 9. In this embodiment, the EGR line opens into the intake line 2, for example downstream of compressor 8 or the charge air cooler 12.

Figure 2:
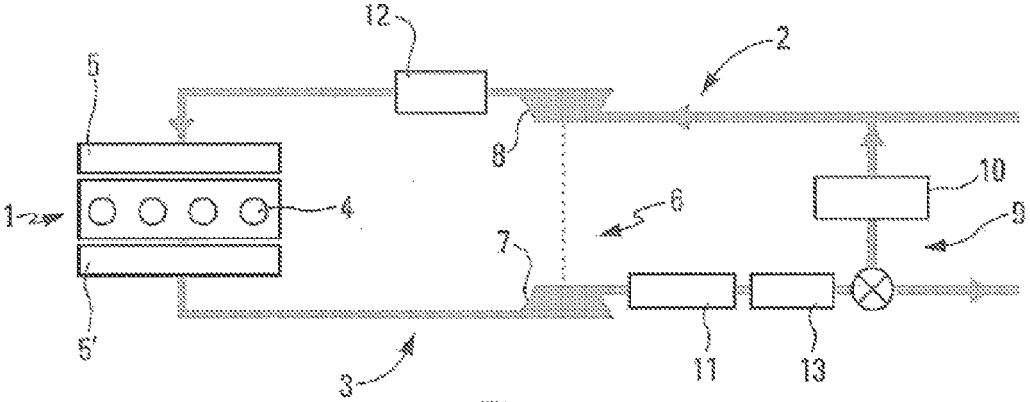
FIG. 2 illustrates diagrammatically a second exemplary embodiment of the device according to the invention.
Figure 3:
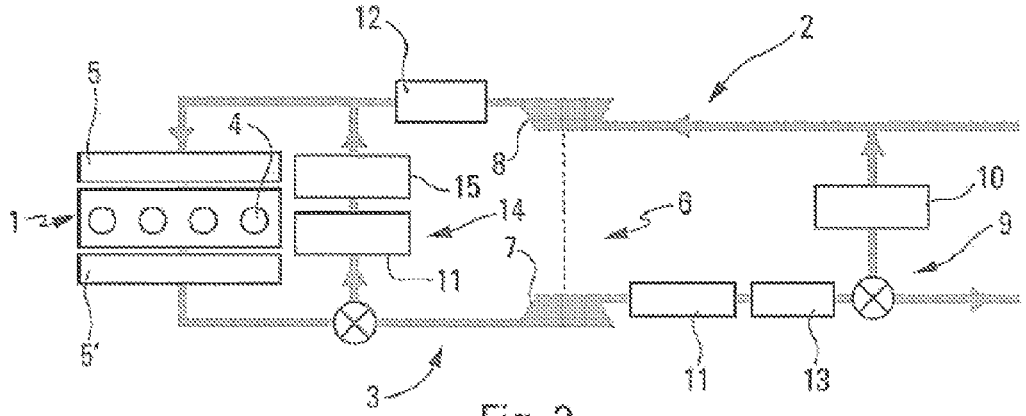
FIG. 3 illustrates diagrammatically a third exemplary embodiment of the device according to the invention.

According to other embodiments corresponding to those of FIGS. 2 and 3, said first EGR line 9 is provided so as to be able to communicate with said exhaust line 3 downstream of said turbine 7 or the particle filter 13. Said treatment means 11 are then located for example along said exhaust line 3, in particular downstream of said turbine 7, for example upstream of the particle filter 13. In such a configuration, the three-way catalyst therefore processes the entirety of the exhaust gases which have passed through the turbine 7.

The EGR line 9 opens into said intake line, for example upstream of the compressor 8.

According to a first variant corresponding to the embodiment in FIG. 2, no other EGR line is provided.

According to other variants a second exhaust gas recirculation line 14 can be provided. Said second EGR line is provided able to communicate with the exhaust line 3 upstream of said turbine 7. A second heat exchanger 15 is provided on said second EGR line 14 to cool the recirculated exhaust gases passing into said second line 14. The latter opens into the intake line, for example downstream of the compressor 8 or the charge air cooler 12.

According to a first exemplary embodiment, not shown, said second exchanger 15 comprises a heat exchanger bundle made of stainless steel.

According to a second exemplary embodiment corresponding to FIG. 3, treatment means 11, in particular a second two-way catalyst, are also provided along said second EGR line 14 upstream of said second exchanger 15. Said exchanger 15 then comprises a heat exchanger bundle made of aluminum and/or aluminum alloy.

The invention furthermore concerns the use of the device as described above with fuels of vegetable origin, in particular fuel based on soya oil, palm oil or rapeseed oil, or fuels from biomass. The fuel could also be standard European diesel, in particular diesel with 10 ppmS, or fuels from gas or coal.

The invention claimed is:

1. A device for recirculating exhaust gases from an engine of a motor vehicle, comprising a first exhaust gas recirculation line, a first heat exchanger provided on said first exhaust gas recirculation line to ensure cooling of the recirculating exhaust gases, and a first treatment means for the recirculating exhaust gases for limiting the pH of the condensate arising from the recirculating exhaust gases, said first treatment means being provided upstream of said first heat exchanger along a first path of the recirculating exhaust gases and said first heat exchanger comprising a first heat exchanger bundle made of aluminum and/or aluminum alloy;

wherein said engine comprises an exhaust line and said exhaust line comprises a turbine driven by the recirculating exhaust gases, said first exhaust gas recirculation line communicating with said exhaust line downstream of said turbine, said first treatment means located along said exhaust line;

wherein said engine further comprises an air intake line having a compressor and a supercharging air cooler, said first exhaust gas recirculation line communicating with said air intake line upstream of said compressor and said supercharging air cooler;

wherein said device further comprises a second exhaust gas recirculation line, said second exhaust gas recirculation line communicating with said exhaust line upstream of said turbine and communicating with said air intake line downstream of said compressor and downstream of said supercharging air cooler, said second exhaust gas recirculation line comprising a second heat exchanger to cool the recirculating exhaust gases entering said air intake line downstream of said compressor and downstream of said supercharging air cooler, and wherein the exhaust line further comprises a first valve and a second valve, the first valve located at the communication intersection of the exhaust line with the second exhaust gas recirculation line for regulating the flow of the recirculating exhaust gases between the second exhaust gas recirculation line and a portion of the exhaust line downstream from the first valve; and the second valve located at the communication intersection of the exhaust line with the first exhaust gas recirculation line for regulating the flow of the recirculating exhaust gases between the first exhaust gas recirculation line and exhaust gases exiting the device.

2. The device as claimed in claim 1, wherein the first treatment means for the recirculating exhaust gases comprise an oxidation catalyst for the recirculating exhaust gases.

3. The device as claimed in claim 1, wherein said second heat exchanger comprises a heat exchanger bundle made of stainless steel.

4. The device as claimed in claim 1, wherein a second treatment means are also provided along said second exhaust gas recirculation line upstream of said second heat exchanger, and said second heat exchanger comprises a heat exchanger bundle made of aluminum and/or aluminum alloy.

5. A method for recirculating exhaust gases from an engine of a motor vehicle having a device as claimed in claim 1, said method comprising:

introducing fuels of vegetable origin to the engine of the motor vehicle for combustion.

6. A method for recirculating exhaust gases from an engine of a motor vehicle having a device as claimed in claim 1, said method comprising:

introducing diesel fuel, fuels from gas or coal to the engine of the motor vehicle for combustion.

7. The device as claimed in claim 1, wherein said second exhaust gas recirculation line communicates with said air intake line upstream of an intake manifold of the engine.

8. The device as claimed in claim 1, wherein said exhaust line further comprises a particle filter, said particle filter located downstream of said first treatment means and upstream of said second valve and said first heat exchanger.

9. A device for recirculating exhaust gases from an engine of a motor vehicle, said device comprising:

an air intake line communicating with an intake manifold of the engine and comprising a compressor and a supercharging air cooler;

an exhaust line for receiving the recirculating exhaust gases from an exhaust manifold of the engine and comprising a turbine driven by the recirculating exhaust gases;

a first exhaust gas recirculation line communicating with said exhaust line, said first exhaust gas recirculation line also communicating with said air intake line upstream of said compressor and upstream of said supercharging air cooler; said first exhaust gas recirculation line comprising a first heat exchanger for cooling the recirculating exhaust gas entering said air intake line upstream of said compressor and upstream of said supercharging air cooler, wherein said first heat exchanger comprises a first heat exchanger bundle made of aluminum and/or aluminum alloy;

a first treatment means provided downstream of said turbine and along said exhaust line, said first treatment means provided upstream of said first heat exchanger for limiting the pH of the condensate of the recirculating exhaust gases entering said first heat exchanger;

a second exhaust gas recirculation line for the recirculating exhaust gases communicating with said exhaust line upstream of said turbine, said second exhaust gas recirculation line also communicating with said air intake line downstream of said compressor and downstream of said supercharging air cooler; said second exhaust gas recirculation line comprising a second heat exchanger for cooling the recirculating exhaust gas entering said air intake line downstream of said compressor and downstream of said supercharging air cooler, and wherein the exhaust line further comprises a first valve and a second valve, the first valve located at the communication intersection of the exhaust line with the second exhaust gas recirculation line for regulating the flow of the recirculating exhaust gases between the second exhaust gas recirculation line and a portion of the exhaust line downstream from the first valve; and the second valve located at the communication intersection of the exhaust line with the first exhaust gas recirculation line for regulating the flow of the recirculating exhaust gases between the first exhaust gas recirculation line and exhaust gases exiting the device.

10. The device of claim 9, wherein said second heat exchanger comprises a second heat exchanger bundle made of aluminum and/or aluminum alloy.

11. The device of claim 9, wherein said second heat exchanger comprises a second heat exchanger bundle made of stainless steel.

12. The device as claimed in claim 9, wherein said first treatment means for the recirculating exhaust gases comprises an oxidation catalyst.

13. The device as claimed in claim 9, wherein said second exhaust gas recirculation line further comprises a second treatment means, said second treatment means located upstream of said second heat exchanger, said second treatment means limiting the pH of the condensate of the recirculating exhaust gases entering said second heat exchanger.

14. The device as claimed in claim 13, wherein the second treatment means for the recirculating exhaust gases comprises an oxidation catalyst.

15. The device as claimed in claim 12, wherein said second exhaust gas recirculation line further comprises a second treatment means, said second treatment means located upstream of said second heat exchanger.

16. The device as claimed in claim 15, wherein the second treatment means for the recirculating exhaust gases comprises an oxidation catalyst.

17. The device as claimed in claim 9, wherein said second exhaust gas recirculation line communicates with said air intake line upstream of said intake manifold.

18. The device as claimed in claim 9, wherein said exhaust line further comprises a particle filter, said particle filter located downstream of said first treatment means and upstream of said second valve and said first heat exchanger.

* * * * *